United States Patent [19]

Ichikawa

[11] 4,022,051

[45] May 10, 1977

[54] FEEDING APPARATUS OF MEMBERS TO BE CRIMPED IN CRIMPING TOOLS

[76] Inventor: Seiichi Ichikawa, No. 877-12, Fukuda, Sakai, Japan

[22] Filed: May 10, 1976

[21] Appl. No.: 684,899

[30] Foreign Application Priority Data

May 8, 1975 Japan ..... 50-61758[U]

[52] U.S. Cl. ..... 72/410; 29/751; 29/758; 72/424

[51] Int. Cl.[2] ..... B21D 7/06

[58] Field of Search ..... 72/409, 410, 424; 29/203 DT, 203 DS, 203 H

[56] References Cited

UNITED STATES PATENTS

| | | | |
|---|---|---|---|
| 2,812,676 | 11/1957 | Brown | 72/424 |
| 3,420,086 | 1/1969 | Long | 72/410 |
| 3,423,815 | 1/1969 | Spangler | 29/203 DS |
| 3,487,524 | 1/1970 | Filia | 29/203 H |
| 3,625,350 | 12/1971 | Ray | 72/410 |
| 3,903,725 | 9/1975 | Rommel | 72/410 |

FOREIGN PATENTS OR APPLICATIONS

| | | | |
|---|---|---|---|
| 1,253,709 | 1/1961 | France | 72/424 |
| 946,393 | 1/1964 | United Kingdom | 72/410 |

*Primary Examiner*—Carl E. Hall
*Assistant Examiner*—Gene P. Crosby
*Attorney, Agent, or Firm*—Larson, Taylor & Hinds

[57] ABSTRACT

A crimping tool is provided for feeding and crimping wire terminals, removably secured to a storage belt. A crimping projection is provided on an upper jaw and a receiving body including a plurality of receiving cavities is rotatably mounted on a lower jaw. The projection is received by one of the cavities as the upper jaw moves toward the lower jaw. A ratchet wheel including a plurality of teeth is coaxially mounted on the receiving body and rotatable therewith. A first spring is mounted in said upper jaw so as to engage the teeth of the ratchet wheel. The movement of the upper jaw and spring away from the lower jaw rotates the receiving body in a first direction. A second spring is mounted on said lower jaw so as to engage the ratchet teeth and prevent rotation of the receiving body in a direction counter to the first direction. A retaining mechanism retains the belt of the workpiece so that a portion of the workpiece to be crimped is retained in the receiving cavity, and a receiving case is mounted on the lower jaw for storing the belt of workpieces. The movement of the upper jaw toward the lower jaw causes the crimping projection to be received by the receiving cavity so as to crimp the portion of the workpiece received in the cavity. The movement of the upper jaw away from the lower jaw causes the receiving body to rotate so as to index an adjacent cavity with a workpiece received therein, into position preparatory to being crimped.

6 Claims, 7 Drawing Figures

FEEDING APPARATUS OF MEMBERS TO BE CRIMPED IN CRIMPING TOOLS

FIELD OF THE INVENTION

This invention relates to crimping tools and, in particular, to crimping tools that continuously feed workpieces.

BACKGROUND OF THE INVENTION

Known, hand-held crimping tools which are used to individually crimp workpieces, as for example, terminals, to the end part of lead-wires, have several disadvantages. A first disadvantage is that in prior art tools two hands, exerting considerable force, are required to crimp terminals to wires. Further, such a device is extremely inefficient, resulting in increased labor cost.

The present device relates to an apparatus by which the customary inefficiencies are resolved, in that the present device automatically, continuously, and rapidly feeds and crimps terminals to the ends of lead wires.

A crimping tool for individually feeding and crimping a plurality of workpieces removably secured to a storage belt is provided and includes a lower jaw and an upper jaw coupled to the lower jaw so as to be movable relative thereto. A crimping projection is provided on the upper jaw and receiving body including a plurality of receiving cavities is rotatably mounted on said lower jaw. The projection is received by one of said receiving cavities as the upper jaw moves toward the lower jaw. A ratchet wheel including a plurality of teeth is coaxially mounted on the receiving body and rotatable therewith. A spring is mounted on said upper jaw so as to engage the ratchet teeth. The movement of the upper jaw and spring away from the lower jaw rotates the receiving body in a first direction. The crimping tool further includes a retaining mechanism for retaining a workpiece to be crimped in the receiving cavity.

A feature of the invention is a receiving case for storing the belt of workpieces, A further feature of the invention is a second spring that engages the ratchet teeth for preventing the rotation of the receiving body in a direction counter to the first direction.

DESCRIPTION OF THE PREFERRED EMBODIMENT

Figure 1:
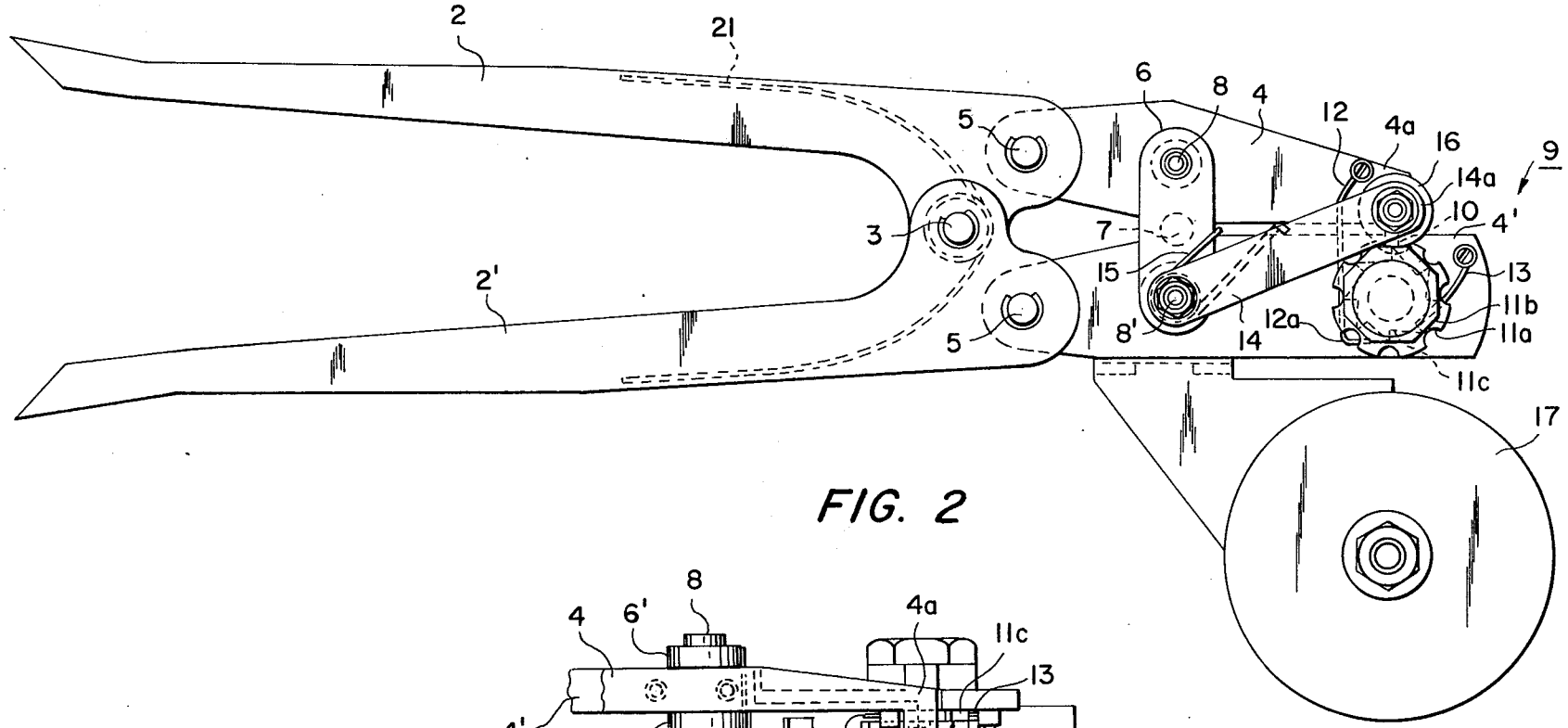
FIG. 1 is a side view of a crimping tool in accordance with the preferred embodiment of the invention.
Figure 2:
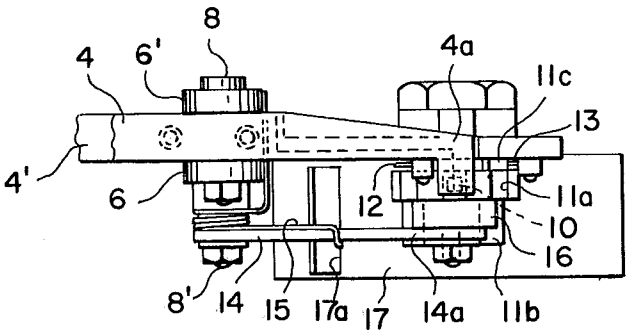
FIG. 2 is a plan view of the crimping tool, the handles of which have been partially removed.
Figure 4:
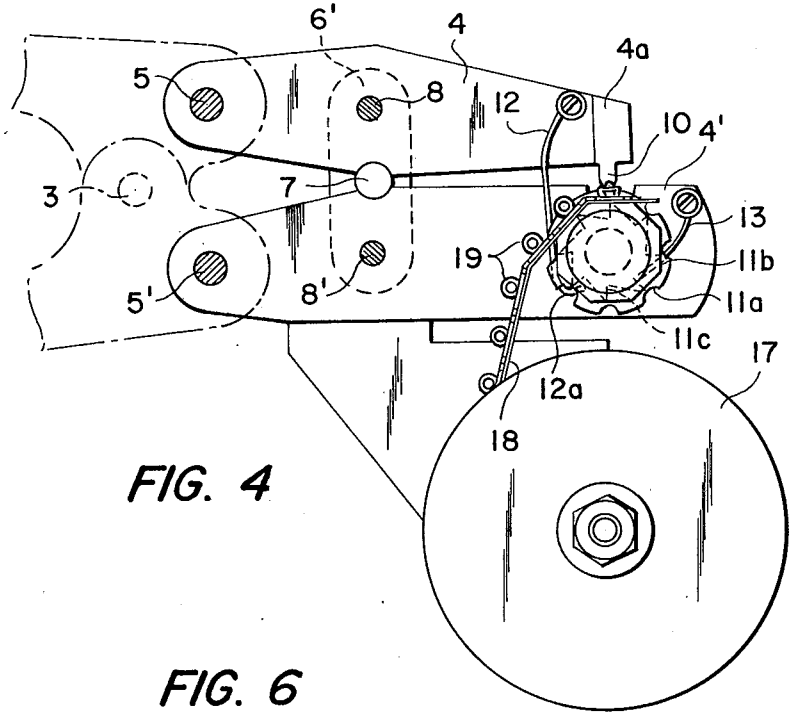
FIG. 4 depicts the crimping tool in a closed operational position.
Figure 5:
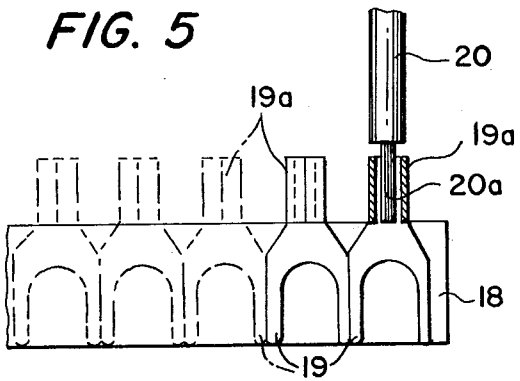
FIG. 5 is an enlarged plan view, partially sectioned, depicting terminals adhering to a tape, one of the terminals receiving a lead-wire.

With reference to the Figures, and in particular to FIGS. 1 through 4, the preferred embodiment of the crimping tool is depicted and includes handles 2 and 2′ pivotally joined by pivot pin 3, and iron pieces 4 and 4′, one end of which is pivotally mounted on the base part of handles 2 and 2′ by pins 5 and 5′. The central part of pieces 4 and 4′ are pivotally mounted to left and right links 6 and 6′, secured thereto by screws 8 and 8′. Further pieces 4 and 4′ slidingly engage pin 7 and are pivotal thereabout. The tool further includes a crimping part 9 consisting of pressing projection 10 provided on the lower face of the upper iron piece 4 at its tip end bent part 4*a*, and receiving body 11, for receiving pressing projection 10, pivotally mounted on the side of the lower iron piece 4′. Receiving body 11 includes a circular plurality of arc shaped cavity parts 11*a* for receiving projection 10, plane parts 11*b*, and ratchet parts 11*c*, the parts of each plurality spaced equidistantly along the periphery of body 11. A spring rod 12 which causes the clockwise rotation of receiving body 11 is secured to upper side iron piece 4. Tip end bent part side 12*a* of spring rod 12 engages ratchet part 11*c* of receiving body 11. Spring rod 13 which prevents the counterclockwise directional rotation of receiving body 11 is secured to lower side iron piece 4′. Tip end part 13*a* of rod 13 engages ratchet part 11*c*. A long link 14 is pivotally mounted on screw 8′ of leftside link 6. Tip end 14*a* of link 14 is urged toward receiving body 11 by spring 15 so that a rotary roll 16, pivotally mounted on tip end 14*a* of link 14, is received by the plane part 11*b* of receiving body 11. A receiving case 17 for receiving a plurality of terminals 19 (FIG. 5) mounted on adhesive tape 18 is secured to the lower face of lower iron piece 4′. Terminals 19 can be removed through a port 17*a* (FIG. 2) in case 17. As depicted in FIG. 5, end part 20*a* of lead-wire 20 is inserted into tubular end part 19*a* of terminal 19. As depicted in FIG. 1, spring 21 urges handles 2 and 2′ apart.

Figure 3:
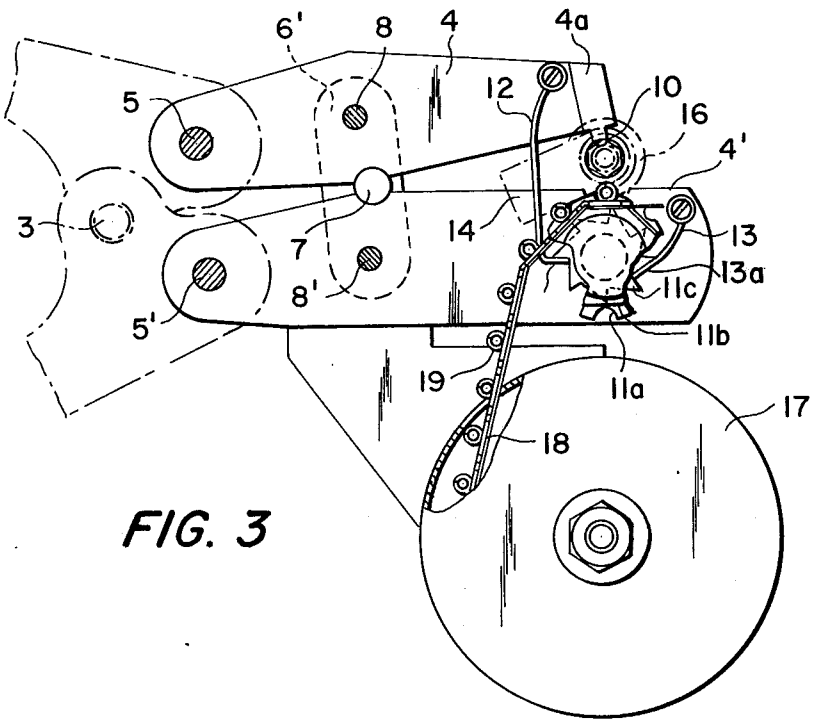
FIG. 3 depicts the crimping tool in an open operational position.

The operation of the crimping tool is as follows. First, handles 2 and 2′ are spread apart, thereby causing the crimping part 9 of upper and lower iron pieces 4 and 4′ to be separated as shown in FIG. 3. An end of tape 18 is pulled through aperture 17*a* of case 17 and is threaded between long link 14 and receiving body 11 so that tubular part 19*a* of the terminal 19 is fitted to cavity part 11*a* of receiving body 11.

Figure 6:
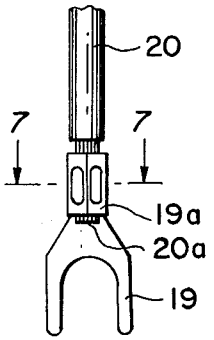
FIG. 6 is a plan view depicting a terminal crimped to a lead-wire.
Figure 7:
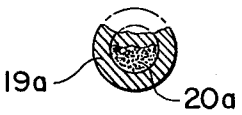
FIG. 7 is an enlarged transverse cross-sectional view taken along line 7—7 in FIG. 6.

When end part 20*a* of lead-wire 20 is inserted into tubular part 19*a* of terminal 19 as shown in FIG. 5 and handles 2 and 2′ are brought together, pressing projection 10 on upper iron piece 4 is pivoted toward receiving body 11. Projection 10 is forced against tubular part 19*a* of terminal 19 in cavity part 11*a* so that end part 20*a* of lead-wire 20 is crimpingly secured within tubular part 19*a* as shown in FIG. 6 and FIG. 7.

When handles 2 and 2′ are again spread apart as shown in FIG. 3, bent part 12*a* at the tip end of spring rod 12 engages ratchet part 11*c* of receiving body 11 and rotates receiving body 11. As body 11 rotates, terminals 19 on tape 18 are drawn out of casing 17 in accordance with the clockwise rotation of said receiving body 11. Tip end part 13*a* of spring rod 13 mounted on the side of lower iron piece 4′ engages ratchet part 11*c* of receiving body 11 so as to prevent body 11 from rotating in a counterclockwise direction. Further, as handles 2 and 2′ are closed as shown in FIG. 4, bent part 12*a*, at the tip end of spring rod 12 mounted on the side of upper iron piece 4 slides downward over and reengages ratchet part 11*c* of receiving body 11 which is prevented from rotating in a counterclockwise direction.

As a main point, when the handles are spread apart, terminal 19 is drawn out of casing 17 in accordance with the clockwise rotation of receiving body 11, and as the handles are closed, pressing projection 10 presses and deforms tubular part 19*a* of terminal 19, thereby terminal 19 and lead-wire 20 are crimped integrally as one body.

As described above, in a feeding apparatus of members to be crimped in crimping tools according to the present device, a pressing projection is provided on the lower face of the side of the upper iron piece at its tip end part. The apparatus further includes a receiving body consisting of circular arc shaped cavity parts that engage said projection, a plane part and a ratchet part that are pivotally mounted on the side of the lower iron piece, the parts being positioned equidistant along the periphery of the receiving body. The apparatus includes a spring rod for clockwise directional rotation of the receiving body and a spring for prevention of reverse directional rotation of the receiving body, secured respectively to the upper iron piece and the lower iron piece in such a relation that the tip end part of each spring engages with said ratchet part. The apparatus includes a long link pivotally mounted on the side of the lower iron piece, and a rotary roll provided at tip end of the long link. The long link is spring urged so as to be pressed against the plane part of said receiving body. Further, the receiving case for the tape on which multiple numbers of terminal adhere is provided on lower iron piece. Accordingly, members to be crimped, such as terminals, can be fed continuously to the crimping part of the apparatus by the opening and closing operation of the handles. Thus such customary labor as is needed to fit the terminal to the cavity part of the receiving body individually is omitted, and the crimping operation is performed conveniently with only one hand. Thus operational efficiency is increased and labor cost is reduced. Moreover, members to be crimped do not obstruct the operator during operation since said members to be crimped are received in a case fixed to the tools, so as to be easily managed.

I claim:

1. A crimping tool for individually feeding and crimping a plurality of workpieces removably secured to a belt comprising a lower jaw; an upper jaw coupled to said lower jaw so as to be movable relative thereto; a crimping projection provided on the said upper jaw; a receiving body including a plurality of receiving cavities for receiving the workpieces to be crimped, said body rotatably mounted on said lower jaw, said crimping projection being received by one of said receiving cavities so as to crimp a workpiece as said upper jaw moves toward said lower jaw; a ratchet wheel including a plurality of teeth coaxially mounted on said receiving body so as to be rotatable therewith; a spring mounted on said upper jaw so as to engage said teeth of said ratchet wheel, the movement of said upper jaw and spring away from said lower jaw for rotating said receiving body in a first direction so as to index the next workpiece received by a next said cavity preparatory to crimping; and a means for retaining the workpiece to be crimped in said cavity.

2. A crimping tool in accordance with claim 1 further including a receiving case, secured to said lower jaw, for storing the belt of workpieces.

3. A crimping tool in accordance with claim 1 further including a spring mounted on said lower jaw so as to engage said teeth of said ratchet wheel for preventing the rotation of said ratchet wheel in a direction counter to the first direction.

4. A crimping tool in accordance with claim 1 further including a handle comprising an upper member pivotally mounted to a lower member, said upper jaw pivotally mounted to said upper member and said lower jaw pivotally mounted to said lower member, wherein said tool further includes a pivot pin positioned between said jaws, a first peripheral surface portion of said pin slidably received by a cavity in said upper jaw and a second peripheral surface portion of said pin slidably received by a cavity in said lower jaw, said tool further including a link pivotally mounted at one end thereof to said upper jaw and pivotally mounted at the other end thereof to said lower jaw so as to retain said pivot pin between and in sliding contact with said upper jaw and said lower jaw.

5. A crimping tool in accordance with claim 1 wherein said retaining means includes a cam coaxially mounted on said receiving body so as to be rotatable therewith, said cam including a plurality of peripheral, planar surfaces, one of said surfaces located adjacent each of said receiving cavities, said retaining means further including a cam follower pivotally mounted on said lower jaw and spring urged toward said planar surface of said cam that is located adjacent said receiving cavity receiving said crimping projection, a portion of the workpiece retained between said planar surface and said cam follower, and a portion of the workpiece located in said receiving cavity.

6. A crimping tool in accordance with claim 5 wherein said cam follower includes a follower member pivotally mounted at one end thereof to said second jaw and a roller, rotatably mounted to the other end of said follower member so as to be in rolling engagement with the workpieces positioned on said planar surfaces.

* * * * *